US009318795B2

(12) United States Patent
Su

(10) Patent No.: US 9,318,795 B2
(45) Date of Patent: Apr. 19, 2016

(54) WIDEBAND ANTENNA AND RELATED RADIO-FREQUENCY DEVICE

(75) Inventor: Chi-Kang Su, Hsinchu (TW)

(73) Assignee: Wistron NeWeb Corporation, Hsinchu Science Park, Hsinchu (TW)

( * ) Notice: Subject to any disclaimer, the term of this patent is extended or adjusted under 35 U.S.C. 154(b) by 269 days.

(21) Appl. No.: 13/585,841

(22) Filed: Aug. 15, 2012

(65) Prior Publication Data

US 2013/0249765 A1 Sep. 26, 2013

(30) Foreign Application Priority Data

Mar. 22, 2012 (TW) ..... 101109847 A

(51) Int. Cl.

| | |
|---|---|
| ***H01Q 1/38*** | (2006.01) |
| ***H01Q 1/50*** | (2006.01) |
| ***H01Q 1/24*** | (2006.01) |
| ***H01Q 15/02*** | (2006.01) |
| ***H01Q 1/00*** | (2006.01) |
| ***H01Q 9/42*** | (2006.01) |
| ***H01Q 5/371*** | (2015.01) |

(52) U.S. Cl.
CPC ..... *H01Q 1/243* (2013.01); *H01Q 5/371* (2015.01); *H01Q 9/42* (2013.01)

(58) Field of Classification Search
CPC ... H01Q 21/24; H01Q 13/206; H01Q 5/0072; H01Q 1/38; H01Q 9/40; H01Q 1/48; H01Q 1/50
USPC ..... 343/700 MS, 850, 702, 909, 722
See application file for complete search history.

(56) References Cited

U.S. PATENT DOCUMENTS

| | | | | |
|---|---|---|---|---|
| 5,513,383 | A * | 4/1996 | Tsao | 455/575.7 |
| 6,753,815 | B2 * | 6/2004 | Okubora et al. | 343/700 MS |
| 7,055,754 | B2 * | 6/2006 | Forster | 235/492 |
| 7,764,232 | B2 | 7/2010 | Achour | |
| 2004/0160380 | A1 * | 8/2004 | Simpson | 343/850 |
| 2007/0229366 | A1 * | 10/2007 | Kim et al. | 343/700 MS |
| 2011/0012789 | A1 * | 1/2011 | Yang et al. | 343/700 MS |
| 2012/0027056 | A1 * | 2/2012 | Shinkai et al. | 375/219 |

FOREIGN PATENT DOCUMENTS

CN 102044738 A 5/2011

* cited by examiner

*Primary Examiner* — Graham Smith
(74) *Attorney, Agent, or Firm* — Winston Hsu; Scott Margo

(57) ABSTRACT

A wideband antenna is disclosed. The wideband antenna includes a ground element electrically connected to a ground, a feed element for feeding in a Radio-Frequency signal, a radiation element electrically connected to the feed element for radiating the Radio-Frequency signal, and at least one meta-material structure electrically connected between the radiation element and the ground element.

16 Claims, 22 Drawing Sheets

WIDEBAND ANTENNA AND RELATED RADIO-FREQUENCY DEVICE

BACKGROUND OF THE INVENTION

1. Field of the Invention

The present invention relates to a wideband antenna and related Radio-Frequency device, and more particularly, to a wideband antenna and related Radio-Frequency device utilizing at least one meta-material structure to change a center frequency.

2. Description of the Prior Art

An antenna is used for transmitting or receiving radio waves, to communicate or exchange wireless signals. An electronic product with a wireless communication function, such as a laptop or a personal digital assistant (PDA), usually accesses a wireless network through a built-in antenna. Therefore, for facilitating easier access to the wireless communication network, an ideal antenna should have a wide bandwidth and a small size to meet the trends of compact electronic products within a permissible range, so as to integrate the antenna into a portable wireless communication equipment.

However, the antenna requires a longer current route to induce a lower frequency RF signal. It is difficult to reach multiple radiation frequency bands in the lower frequency within a limited antenna space.

Therefore, how to improve antenna bandwidth effectively to apply to wireless communication systems with wide frequency bands such as long term evolution (LTE) has become a goal of the industry.

SUMMARY OF THE INVENTION

It is therefore an object of the present invention to provide a wideband antenna and related Radio-Frequency device.

An embodiment of the present invention discloses a wideband antenna. The wide band antenna comprises a ground element electrically connected to a ground, a feed element for feeding in a Radio-Frequency signal, a radiation element electrically connected to the feed element for radiating the Radio-Frequency signal, and at least one meta-material structure electrically connected between the radiation element and the ground element.

Another embodiment of the present invention discloses a Radio-Frequency device. The Radio-Frequency device comprises a Radio-Frequency signal processor for generating a Radio-Frequency signal, and a wideband antenna coupled to the Radio-Frequency signal processor comprising a ground element electrically connected to a ground, a feed element for feeding in the Radio-Frequency signal, a radiation element electrically connected to the feed element for radiating the Radio-Frequency signal, and at least one meta-material structure electrically connected between the radiation element and the ground element.

These and other objectives of the present invention will no doubt become obvious to those of ordinary skill in the art after reading the following detailed description of the preferred embodiment that is illustrated in the various figures and drawings.

DETAILED DESCRIPTION

Meta-materials or Left-Handed Materials are artificial materials engineered to have properties that may not be found in nature, e.g. negative permittivity and permeability. Anti-Snell's Effect, Anti-Doupler Effect or Anti-Cerenkov Effect may be shown when electromagnetic waves propagate in such materials. Meta-materials usually gain their properties from structure rather than composition, microwave frequency meta-materials are usually synthetic, constructed as arrays of electrically conductive elements (such as loops of wire) which have suitable inductive and capacitive characteristics.

Figure 1:
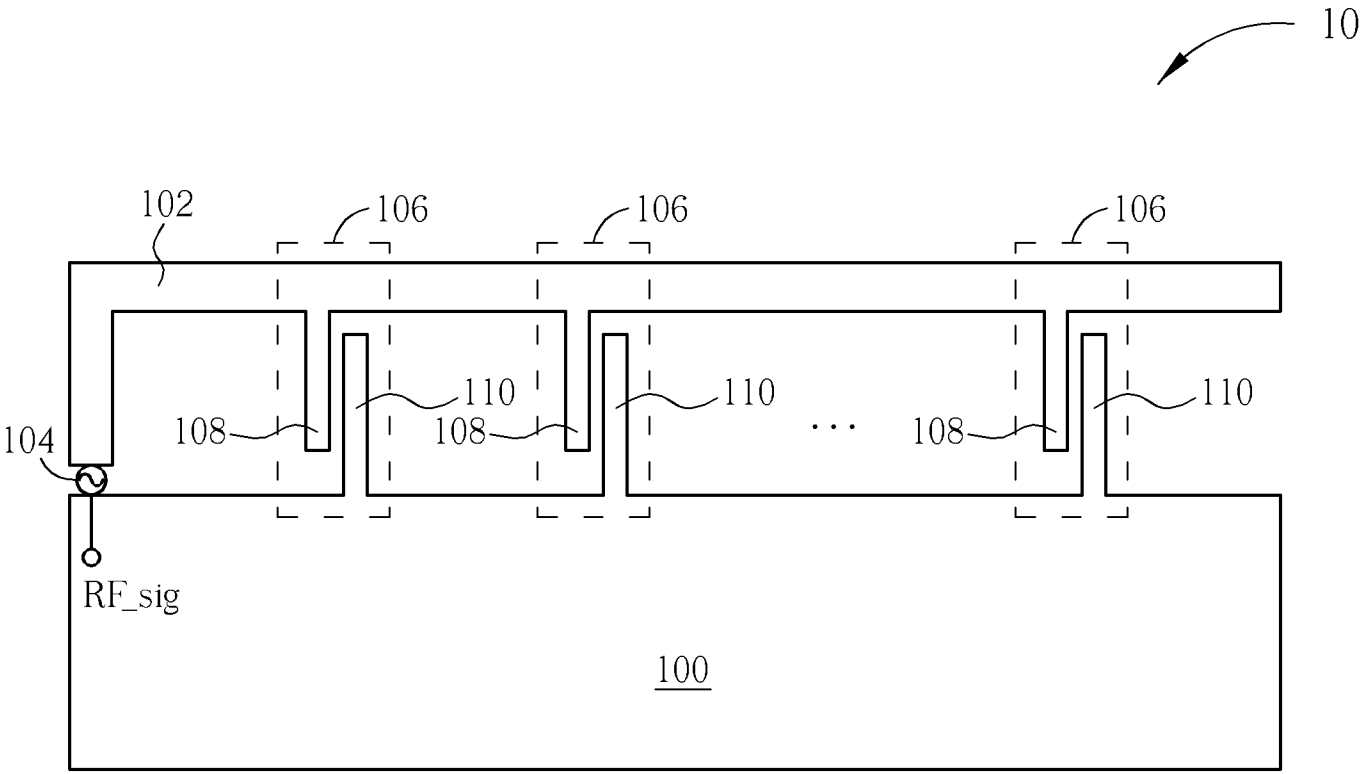
FIG. 1 is a schematic diagram of a wideband the antenna according to an embodiment of the present invention.

Please refer to FIG. 1, which is a schematic diagram of a wideband antenna 10 according to an embodiment of the present invention. The antenna 10 comprises a ground element 100, a radiation element 102, a feed element 104 and at least one meta-material structure 106. The ground element 100 is electrically connected to ground for providing grounding. The feed element 104 is electrically connected between the radiation element 102 and the ground element 100 for feeding a Radio-Frequency (hereinafter called RF) signal RF_sig to the radiation element 102. During signal transmission, the feed element 104 may receive the RF signal RF_sig from an RF signal processor to transmit to the radiation element 102 to perform radio wave transmission. During signal reception, the radiation element 102 may induce the RF signal RF_sig from the air to transmit to the RF signal processor through the feed element 104. The meta-material structure 106 is electrically connected between the radiation element 102 and the ground element 100, the meta-material structure 106 may be disposed periodically and each meta-material structure 106 may be equivalent to a resonator to form such artificial materials to have properties that may not be found in nature, i.e. the negative permittivity and permeability.

Figure 2:
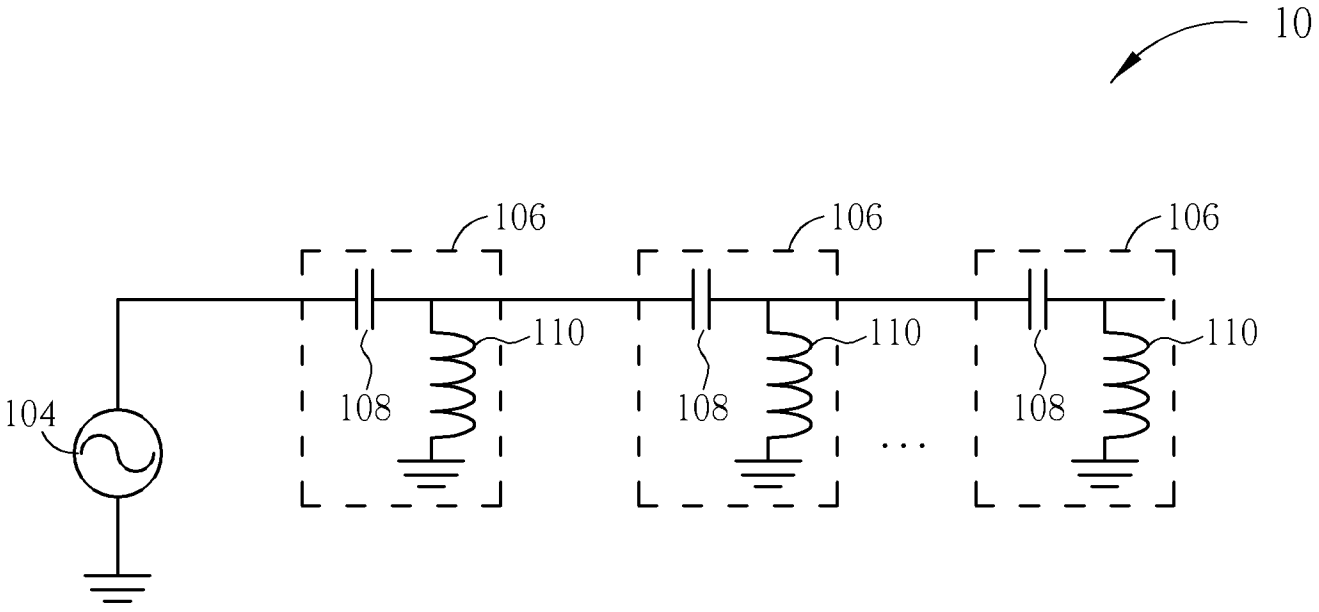
FIG. 2 is a schematic diagram of an equivalent circuit of the antenna shown in FIG. 1.

Please refer to FIG. 2, which is a schematic diagram of an equivalent circuit of the antenna 10. The meta-material structure 106 comprises a capacitive element 108 and an inductive element 110. As shown in FIG. 2, the capacitive element 108 is electrically connected to the radiation element 102, the inductive element 110 is electrically connected to the ground element 100. In such a structure, the capacitive element 108 and inductive element 110 may form the meta-material structure 106 to have a longer length of an effective current route on the radiation element 102, such that a center frequency Fc of the antenna 10 may be shifted to a lower frequency, which effectively reduces a size of the antenna 10.

In other words, the present invention may add the meta-material structure 106 to the radiation element 102 of the antenna 10, such that the center frequency Fc of the antenna 10 may be shifted to the lower frequency, which effectively reduces a size of the antenna 10 if a length of the radiation element 102 remains unchanged. Those skilled in the art may make modifications or alterations accordingly. For example, a number of the meta-material structures 106 is not limited, a designer may increase or decrease the number of the meta-material structures 106 to adjust an amount of frequency shift of the center frequency Fc to meet practical requirements. Specifically, the more the meta-material structures 106, the lower the center frequency Fc. Moreover, the designer may adjust a position of the meta-material structure 106 electrically connected to the radiation element 102, which may generate different amounts of frequency shift of the center frequency Fc and change a bandwidth of the antenna 10 as well.

Figure 3A:
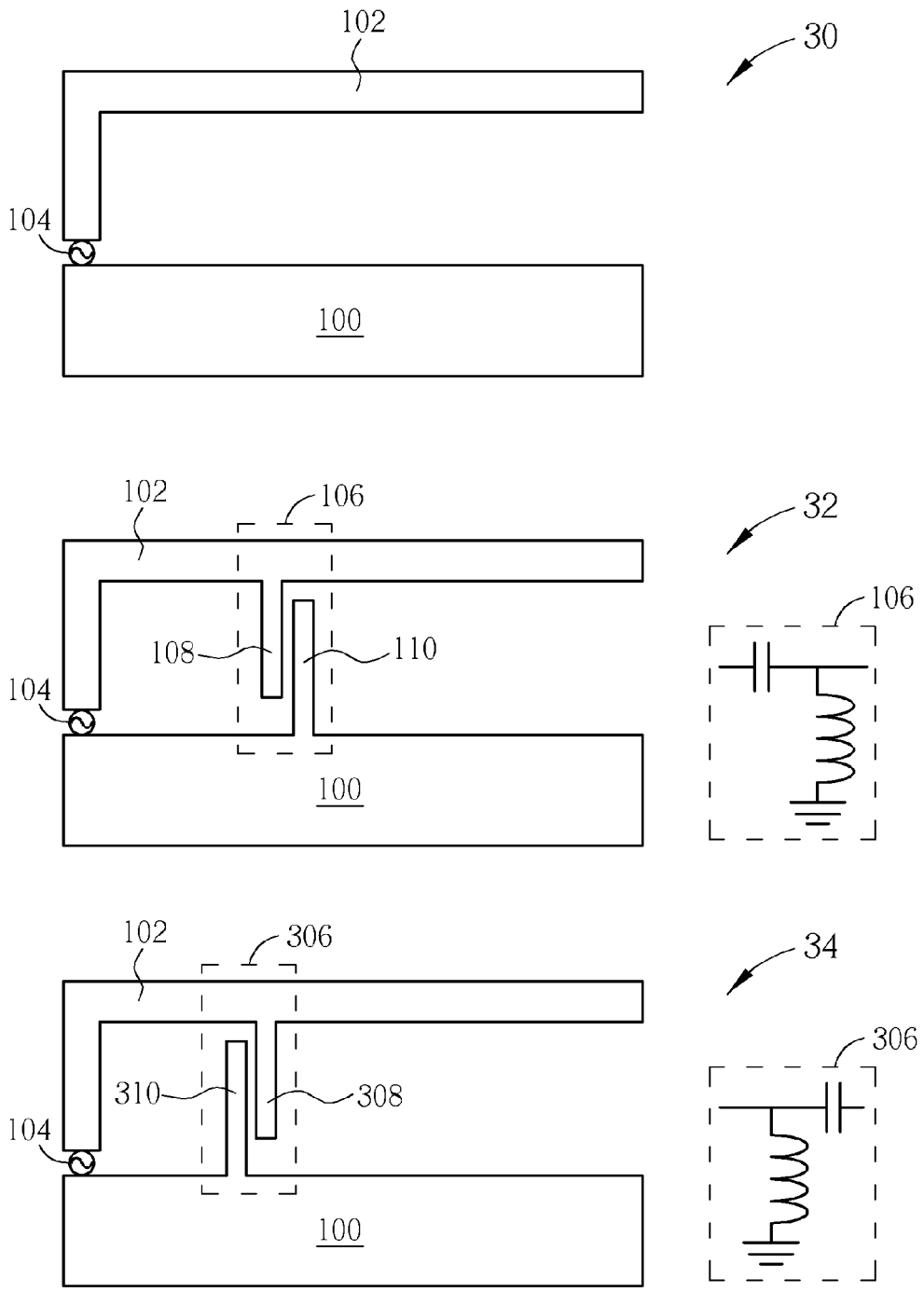
FIG. 3A is a schematic diagram of an antenna and another two antennas having a meta-material structure according to an embodiment of the present invention.
Figure 3B:
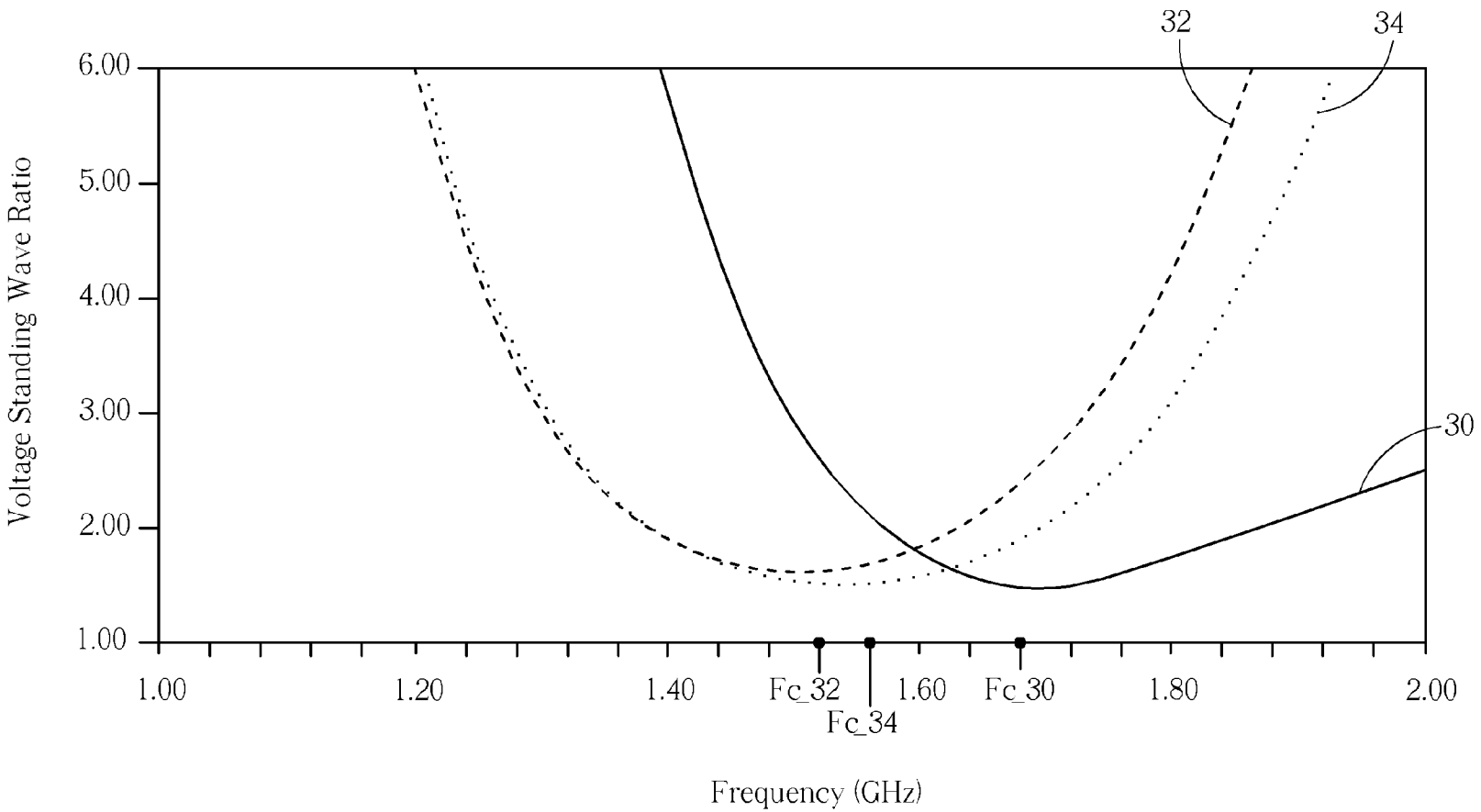
FIG. 3B is a schematic diagram of Voltage Standing Wave Ratios of the antennas shown in FIG. 3A.

Please refer to FIG. 3A and FIG. 3B. FIG. 3A is a schematic diagram of an antenna 30 and antennas 32 and 34 having a meta-material structure according to an embodiment of the present invention. FIG. 3B is a schematic diagram of Voltage Standing Wave Ratios (hereinafter called VSWR) of the antennas 30, 32 and 34. Structures of the antennas 30, 32 and 34 are similar and same elements are denoted with the same symbols. As shown in FIG. 3A, the antenna 30 is a monopole antenna whose radiation center frequency Fc is determined by a length of effective current route of its radiation element, e.g. the length may be equal to a quarter wavelength of the center frequency Fc. The antennas 32 and 34 comprise different meta-material structures 106 and 306, which may generate different amounts of the center frequency Fc shift between the antennas 32 and 34. For the meta-material structure 106, the capacitive element 108 is located between the inductive element 110 and the feed element 104. On the other hand, for the meta-material structure 306, an inductive element 310 is located between a capacitive element 308 and the feed element 104.

In FIG. 3B, the VSWR of the antenna 30 is denoted with a solid line, the VSWR of the antenna 32 is denoted with a dash line, and the VSWR of the antenna 34 is denoted with a dotted line. As shown in FIG. 3B, a center frequency Fc_30 of the antenna 30 is around 1.68 GHz, a center frequency Fc_32 of the antenna 32 is around 1.52 GHz, and a center frequency Fc_34 of the antenna 34 is around 1.56 GHz, wherein a bandwidth difference between the antennas 32 and 34 is about 0.4 GHz. As can be seen, the highest to the lowest center frequency is Fc_30>Fc_34>Fc_32. Thus, adding the meta-material structure 106 to the antenna 32, or adding the meta-material structure 306 to the antenna 34, may generate different amounts of the center frequency Fc shift. Besides, changing the structure of the meta-material structures 106 or 306, i.e. the relative positions between the capacitive elements 108 and 308 and the inductive elements 110 and 310, may generate different amounts of the frequency shift as well.

Hence, if the length, the area and the shape of the radiation element 102 remain unchanged, the center frequency Fc_30 of the antenna 30 may be shifted to the lower center frequency Fc_32 or Fc_34 by adding the meta-material structure 106 or 306 to the antenna 32 or 34, which reduces an antenna size of the antenna 30 effectively.

Figure 4A:
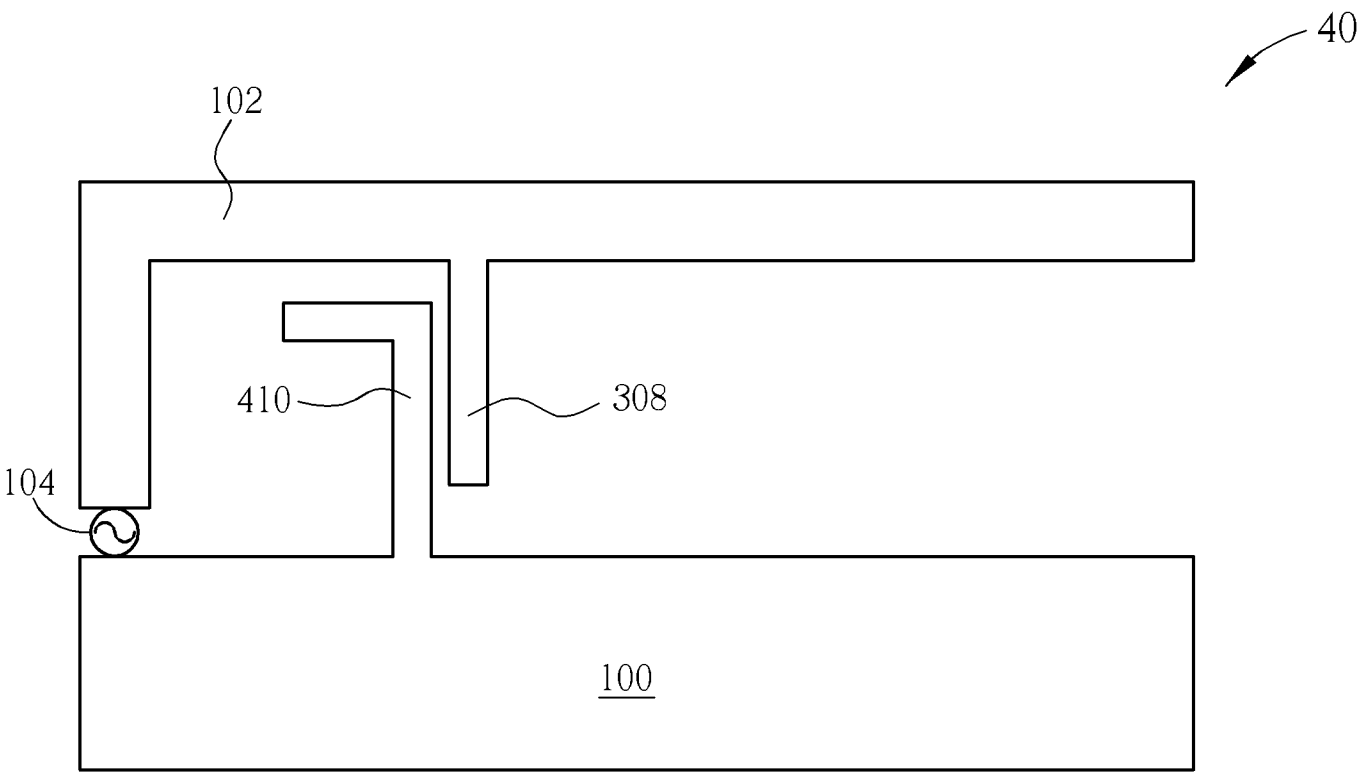
FIG. 4A to FIG. 4C are schematic diagrams of the inductive element having different shapes.
Figure 4B:
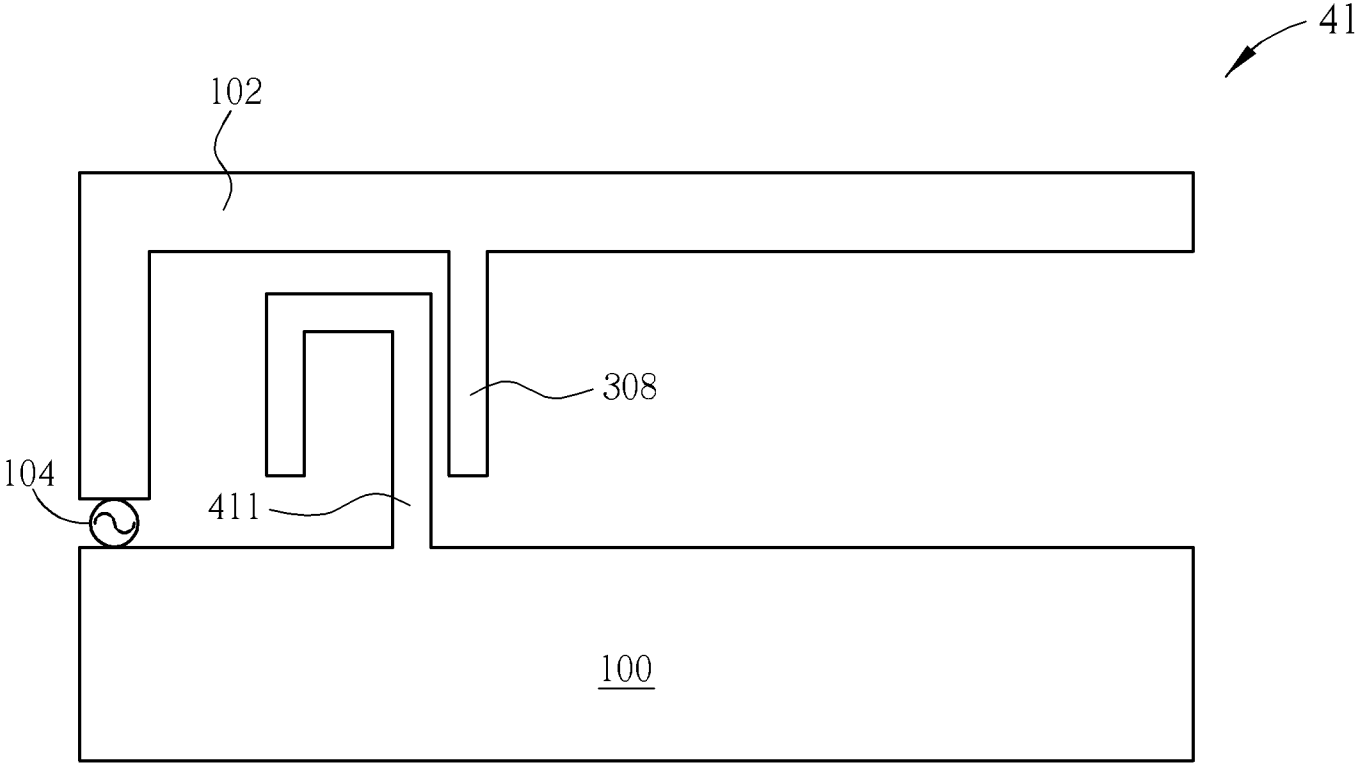
Figure 4C:
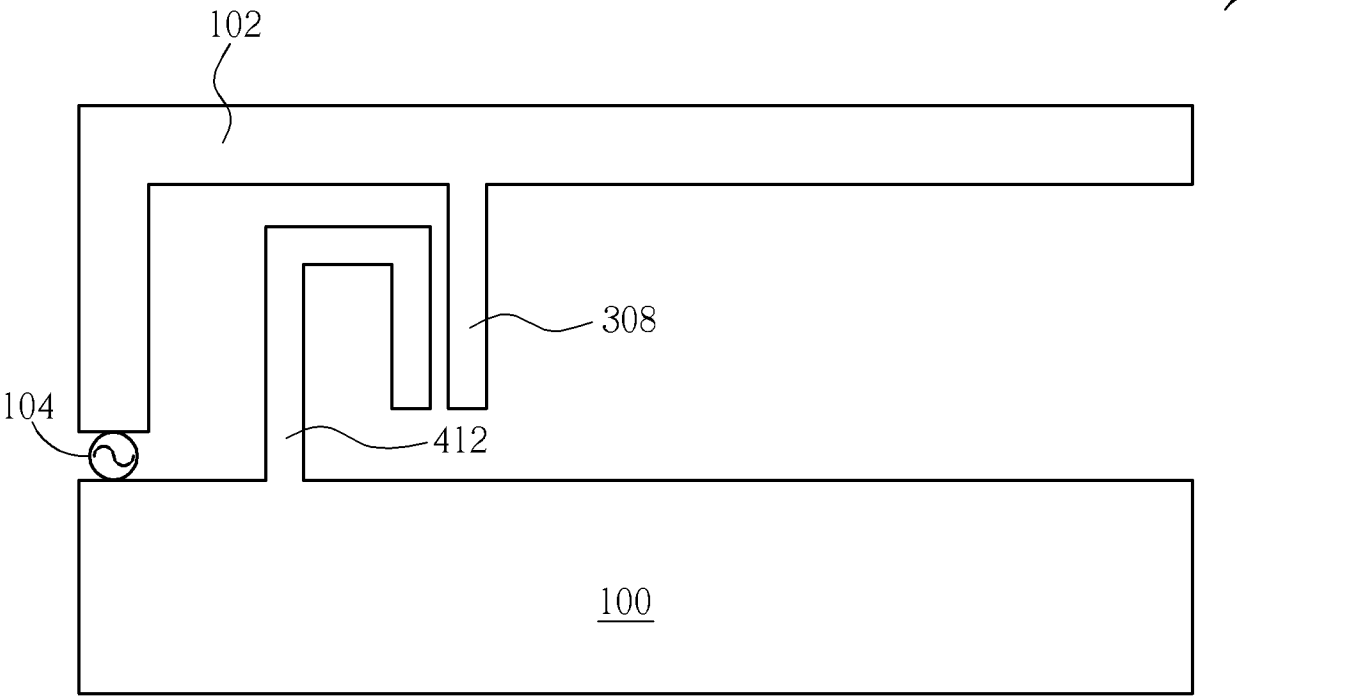

Moreover, shapes of the capacitive elements 108 and 308 and the inductive elements 110 and 310 have no limitation. For example, please refer to FIG. 4A to FIG. 4C, which are schematic diagrams of the inductive element having different shapes. As shown in FIG. 4A to FIG. 4C, an inductive element 410 shown in FIG. 4A comprises an arm and inductive elements 411 and 412 respectively shown in FIG. 4B and FIG. 4C comprise a bended arm, wherein a position where the inductive element 412 is connected to the ground element 100 is different from where the inductive element 411 is connected to the ground element 100, which may generate different amounts frequency shift.

Figure 5A:
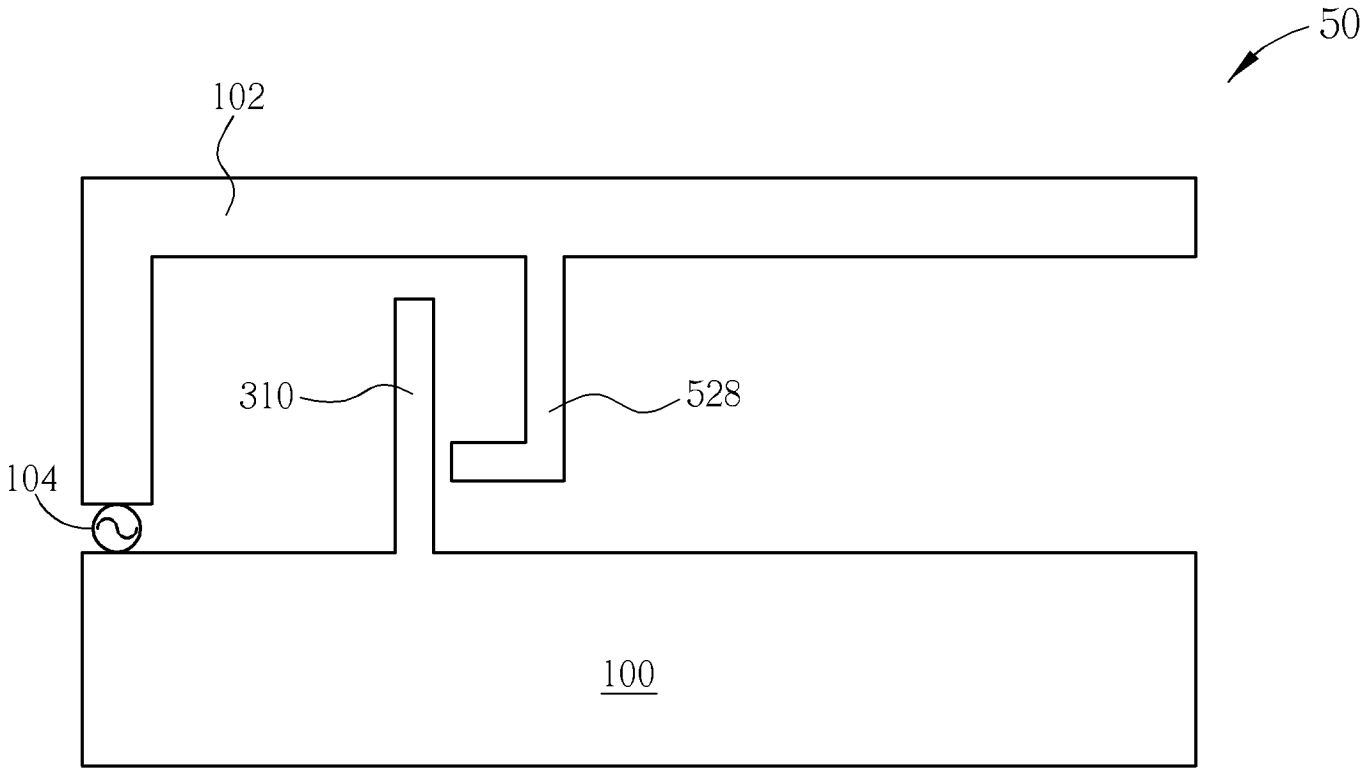
FIG. 5A to FIG. 5C are schematic diagrams of the capacitive element and the inductive element having different shapes.
Figure 5B:
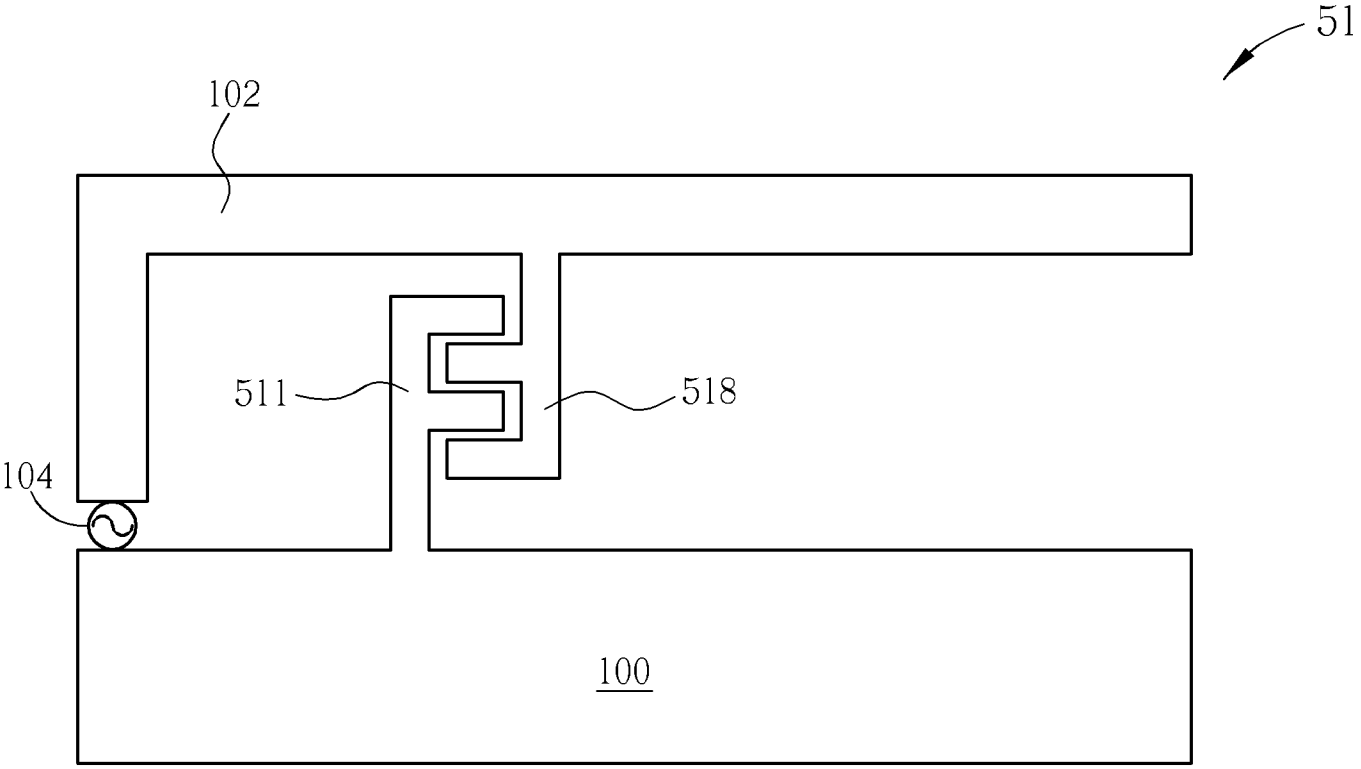
Figure 5C:
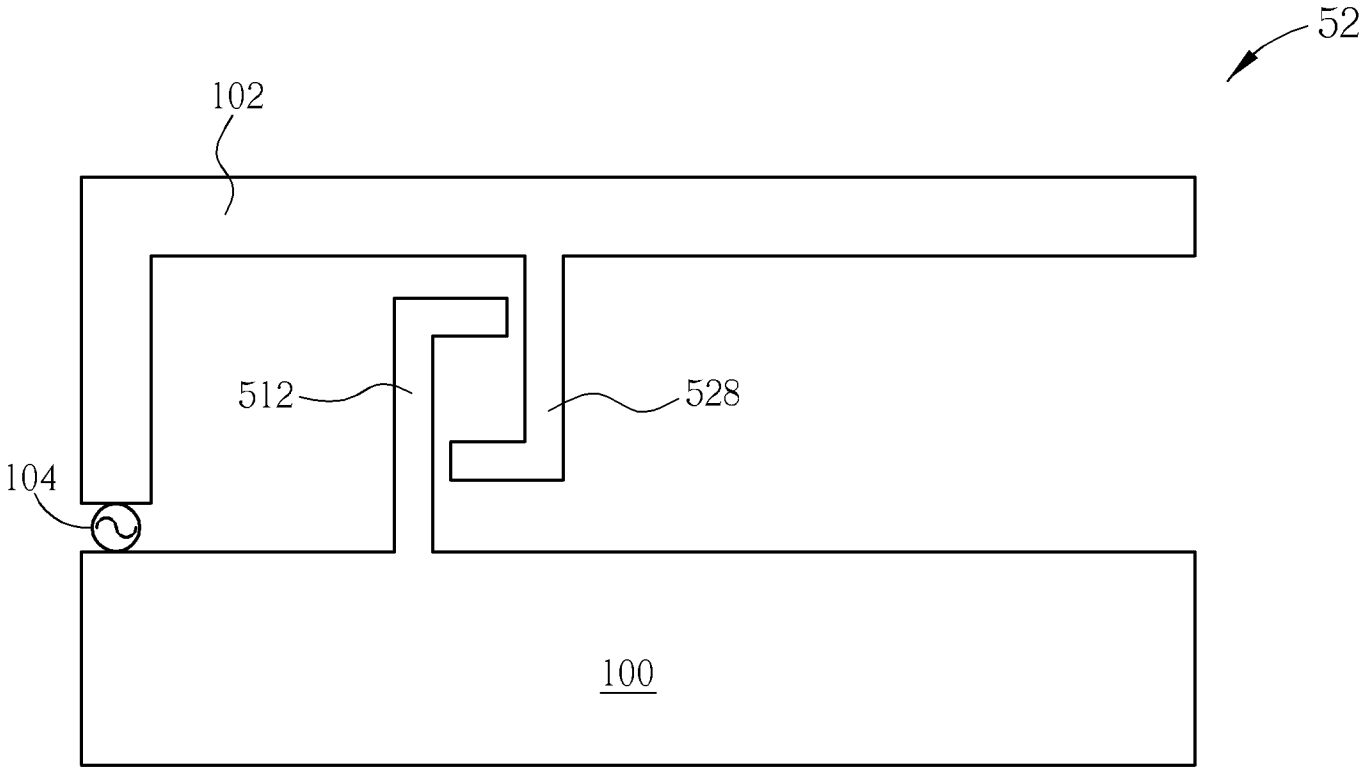

Please refer to FIG. 5A to FIG. 5C, which are schematic diagrams illustrating the capacitive element and the inductive element having different shapes. As shown in FIG. 5A to FIG. 5C, the capacitive elements 518 and 528 comprise at least one arm, an inductive element 511 comprises two arms to form an F-shape, while the capacitive element 518 comprises two arms to form an up-side-down F-shape. Such various shapes of the meta-material structure may generate different amount of frequency shift.

Figure 6A:
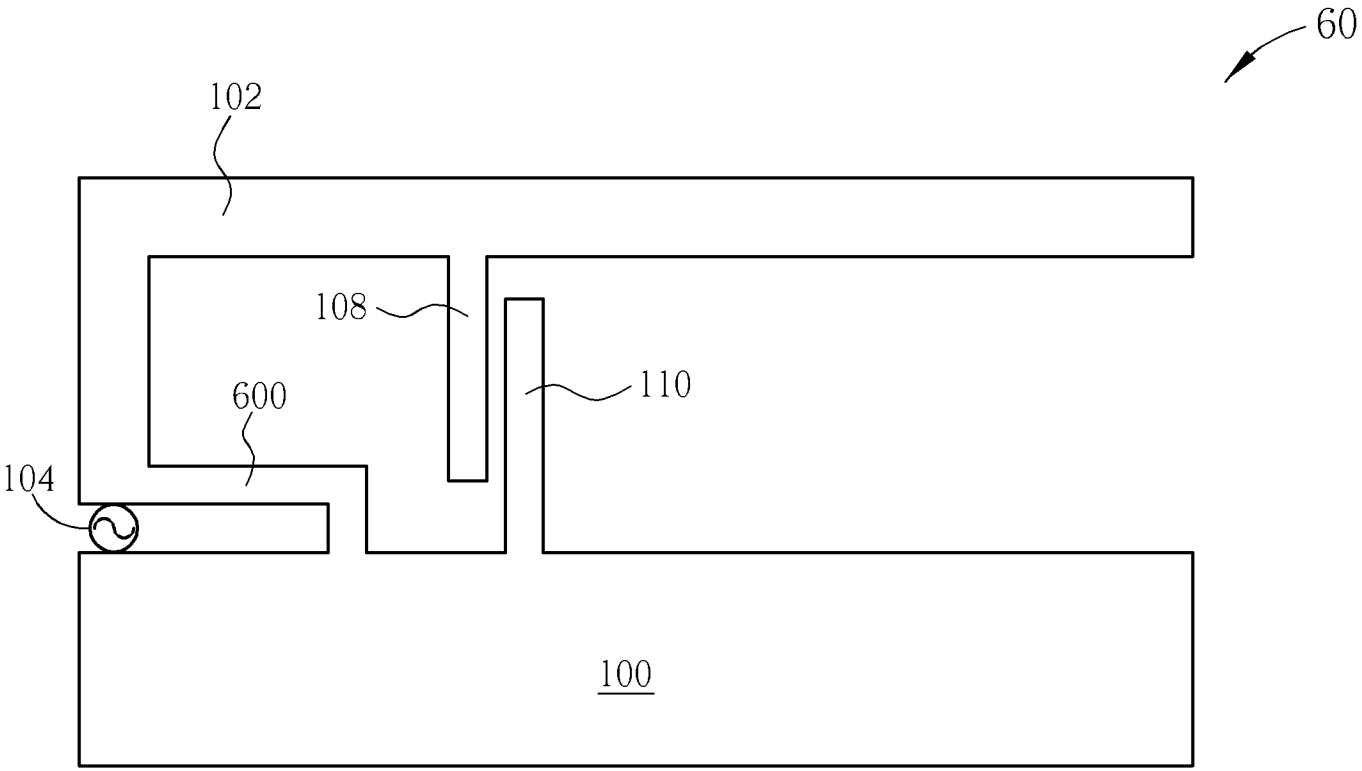
FIG. 6A to FIG. 6F are schematic diagrams of six antennas according to embodiments of the present invention.
Figure 6B:
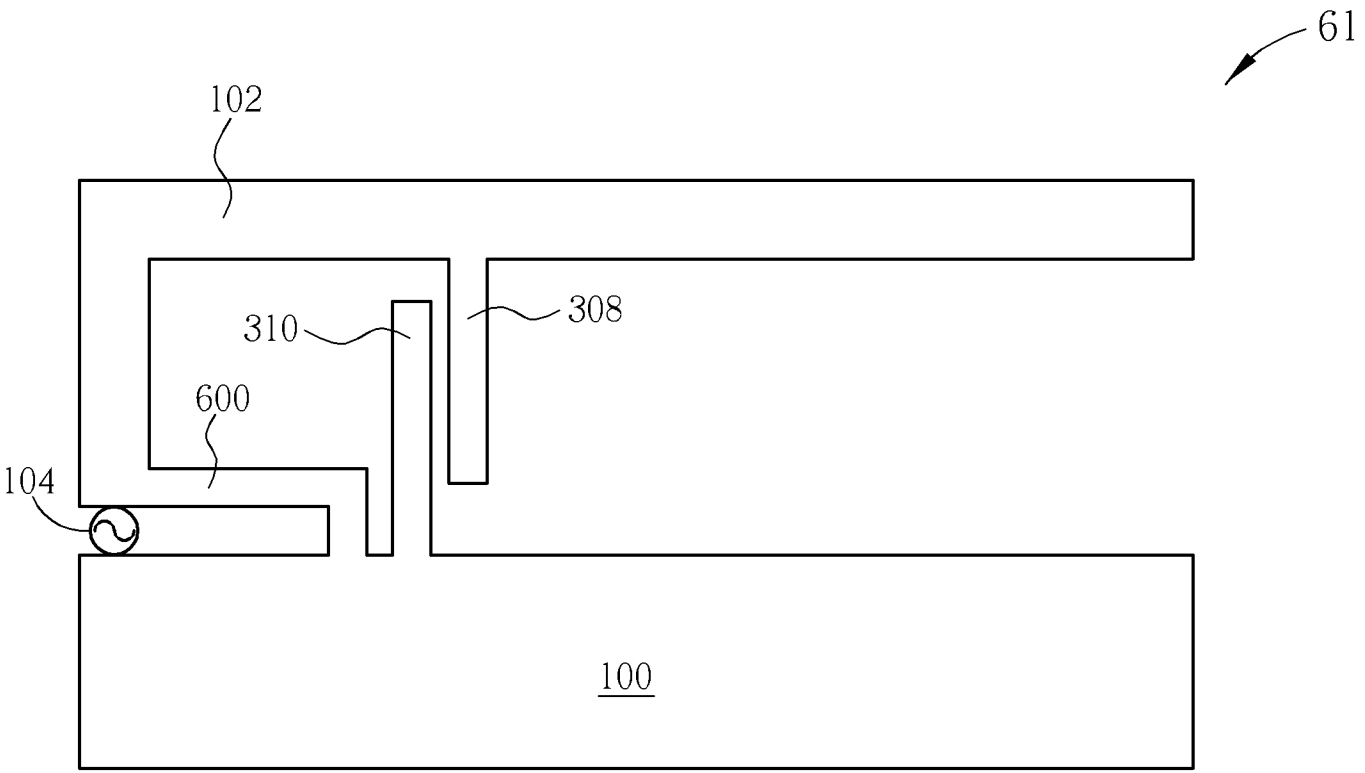
Figure 6C:
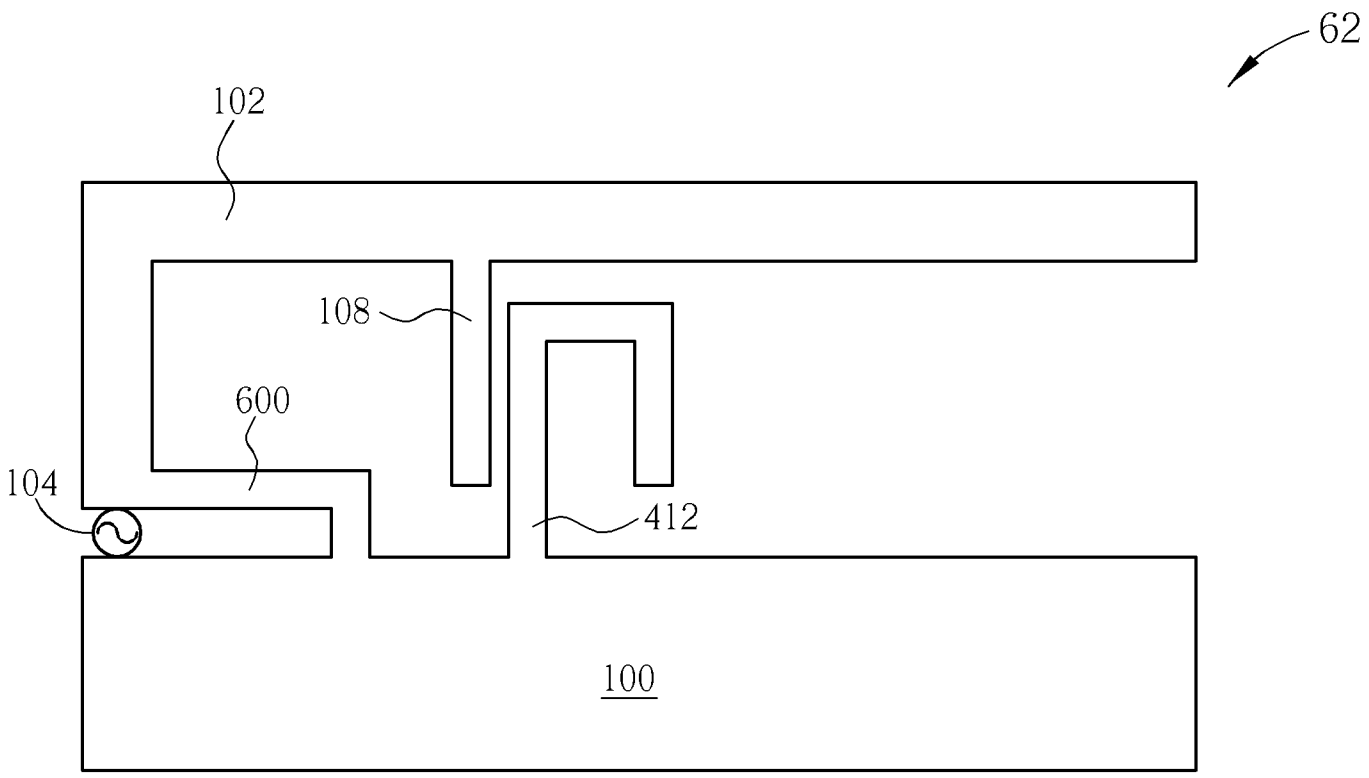
Figure 6D:
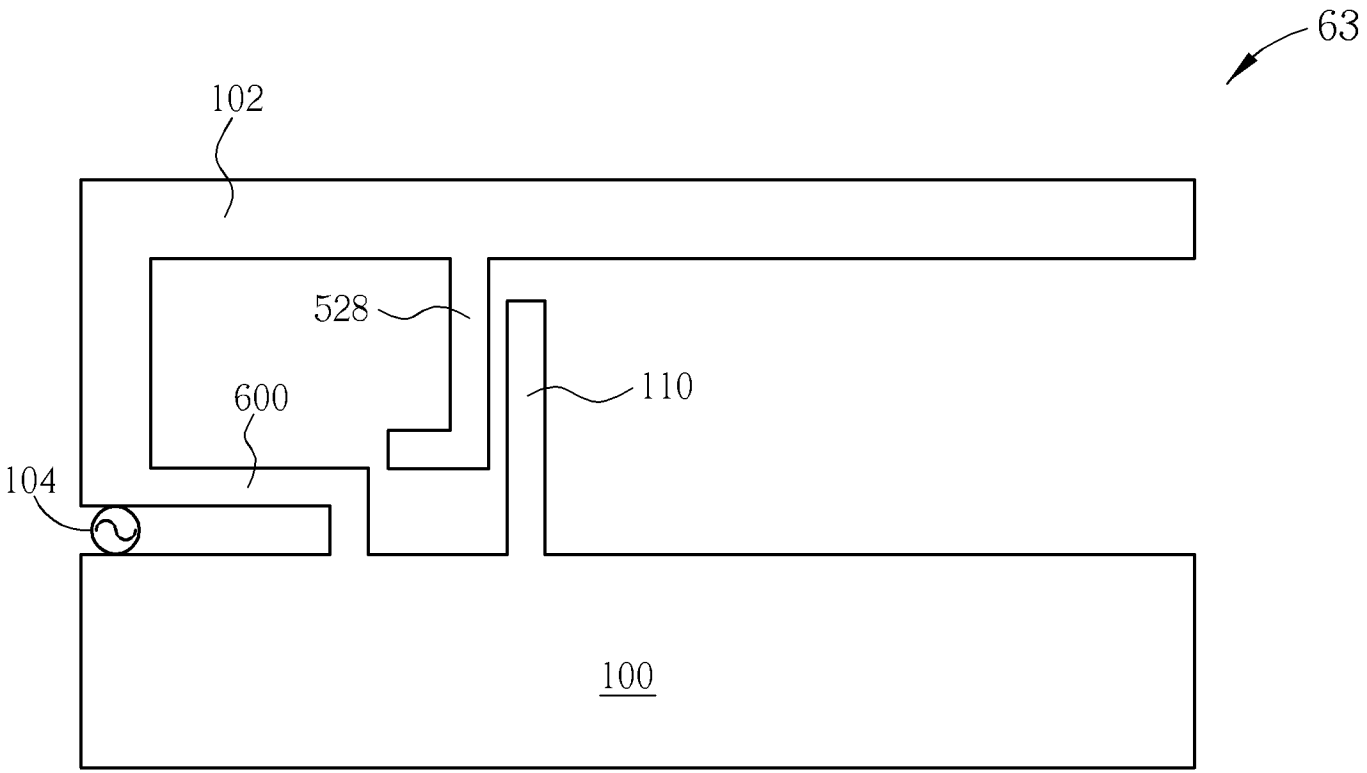
Figure 6E:
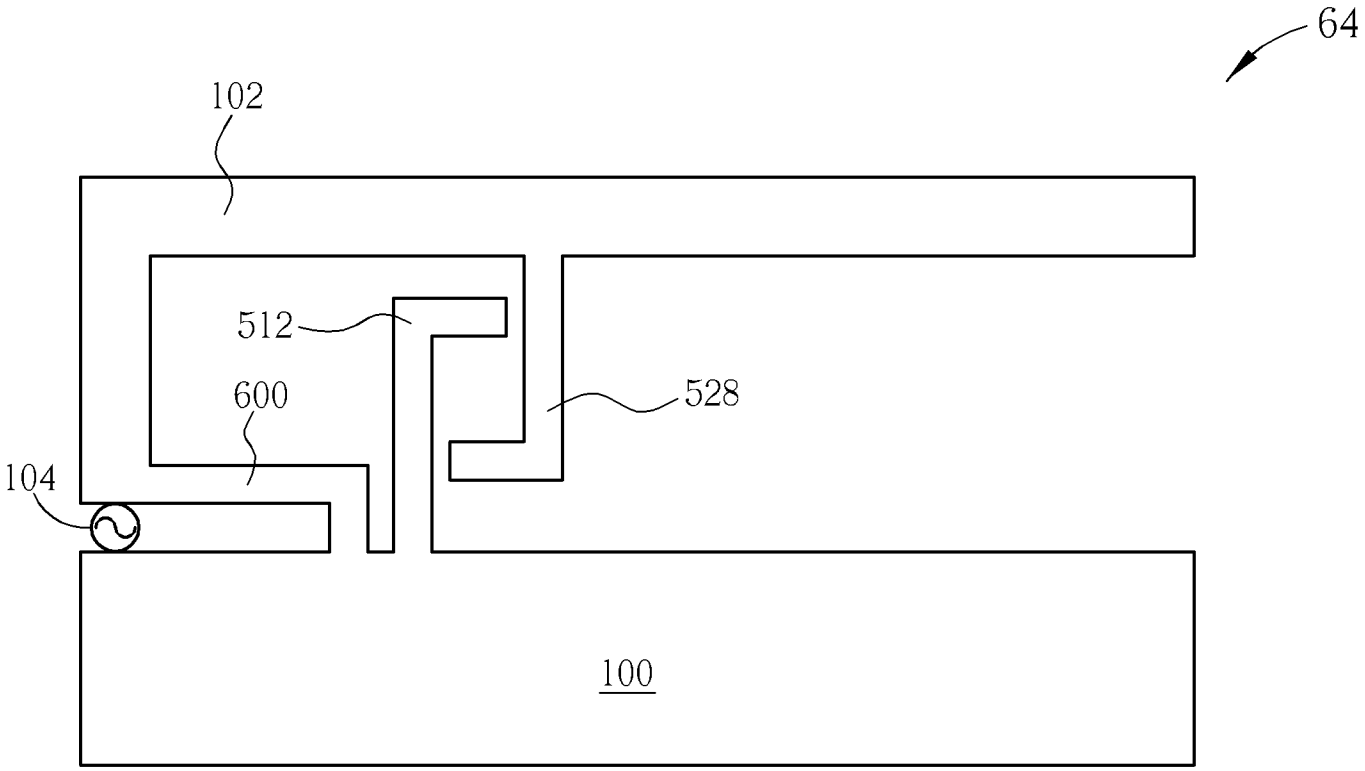
Figure 6F:
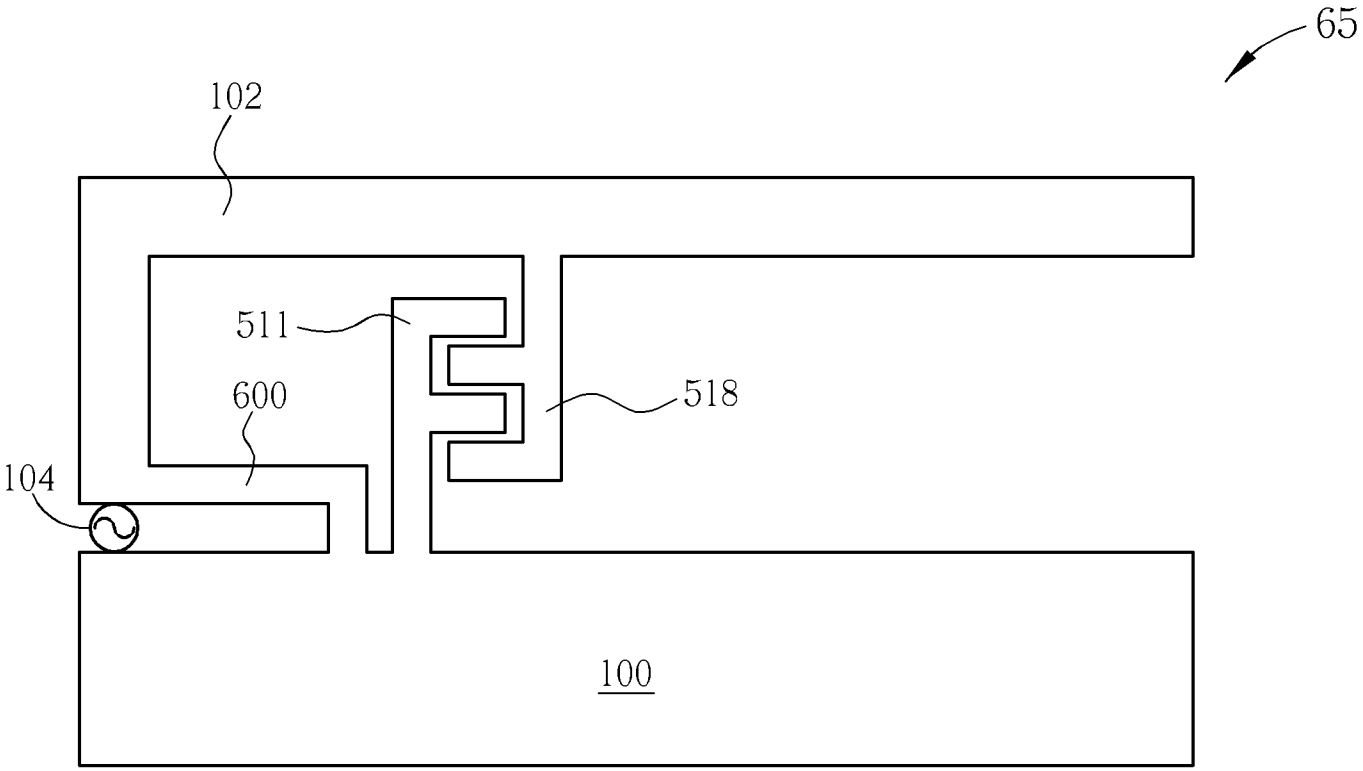

Besides, the antennas 30, 31 and 32 may further comprise a branch to be electrically connected to the ground element 100 to form a Planar Inverted-F Antenna (hereinafter called PIFA). Please refer to FIG. 6A to FIG. 6F, which are schematic diagrams of antennas 60, 61, 62, 63, 64 and 65 according to embodiments of the present invention. In FIG. 6A, the radiation element 102 of the antenna 60 further comprises a branch 600 electrically connected to the ground element 100 to form a PIFA, such that a center frequency of the antenna 60 may be shift to a lower frequency by adding a meta-material structure, which effectively reduces an antenna size of the PIFA, i.e. antenna 60. FIG. 6B to FIG. 6F illustrate different shapes and relative positions of the capacitive element and the inductive element to form different meta-material structures.

Furthermore, since the meta-material structure has a characteristic of changing the radiation center frequency of the antenna, the antenna may further comprise a switch circuit for switching the center frequency of the antenna. As a result, the single antenna may be able to operate between different center frequencies to effectively broaden a bandwidth of the antenna.

Figure 7:
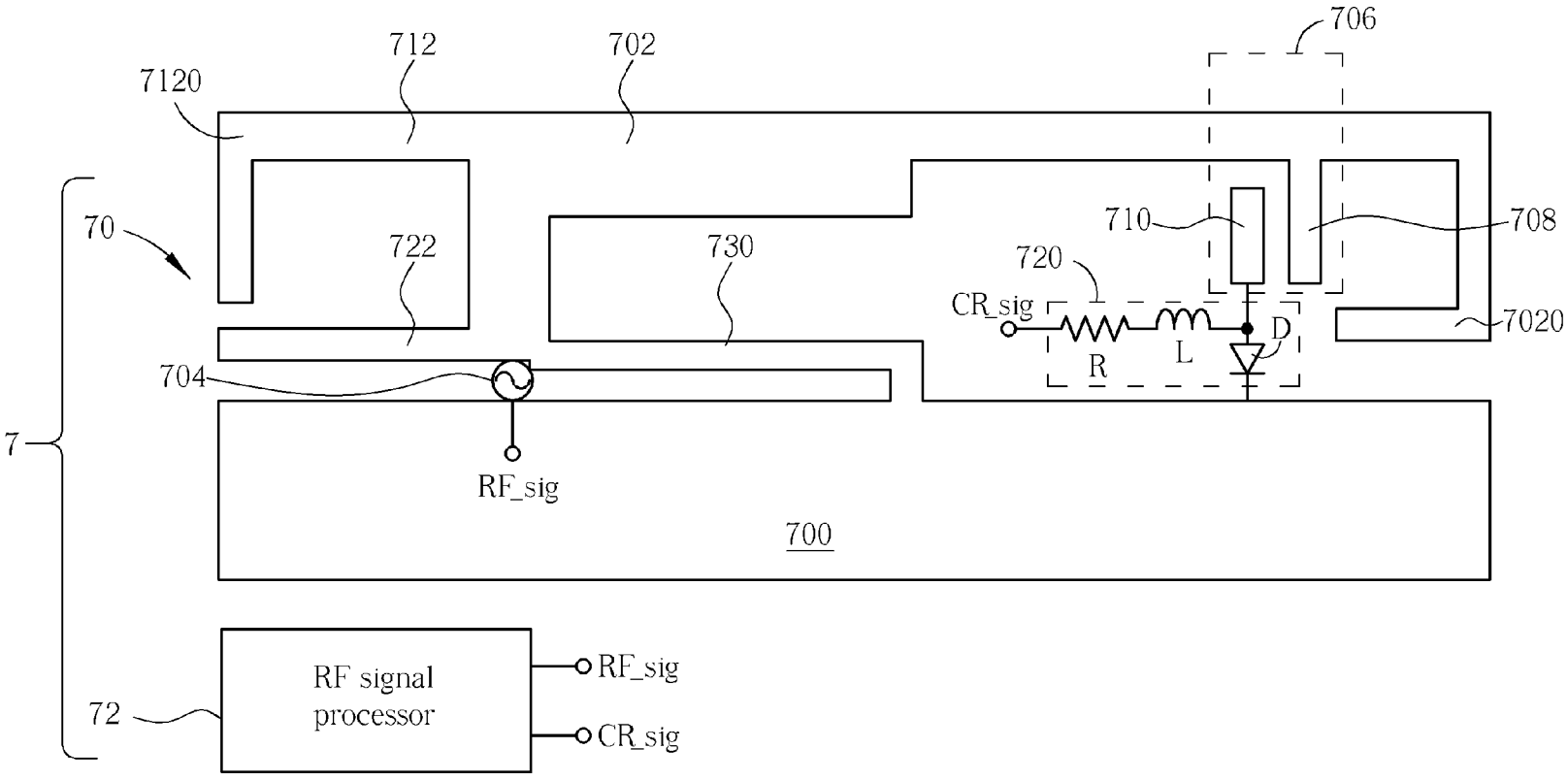
FIG. 7 is a schematic diagram of a Radio-Frequency device according to an embodiment of the present invention.

Specifically, please refer to FIG. 7, which is a schematic diagram of a Radio-Frequency device 7 according to an embodiment of the present invention. The RF device 7 comprises an antenna 70 and an RF signal processor 72. The RF signal processor 72 is coupled to the antenna 70 for generating an RF signal RF_sig to be radiated in the air by the antenna 70. The antenna 70 comprises a ground element 700, radiation elements 702, 712 and 722, a feed element 704, a meta-material structure 706 and a switch circuit 720. The ground element 700 is electrically connected to the ground for providing grounding. The radiation element 702 comprises a branch 730 electrically connected to the ground element 700, such that the antenna 70 is a PIFA. The feed element 704 is electrically connected between the ground element 700 and the radiation elements 702, 712 and 722 for feeding the RF signal RF_sig to the radiation elements 702, 712 and 722. During signal transmission, the feed element 704 may receive the RF signal RF_sig from an RF signal processor 72 to transmit to the radiation elements 702, 712 and 722 to perform radio wave transmission. During signal reception, the radiation elements 702, 712 and 722 may induce the RF signal RF_sig from the air to transmit to the RF signal processor 72 through the feed element 704. As shown in FIG. 7, the radiation elements 702 and 712 may comprise, at least one, bends 7020 and 7120, and the radiation elements 712 and 722 may be regarded as branches of the radiation element 702 for generating different current routes, such that antenna 70 may operate in multiple operating bands at once.

The meta-material structure 706 comprises a capacitive element 708 and an inductive element 710, the capacitive element 708 is electrically connected to the radiation element 702, and the inductive element 710 is electrically connected to the switch circuit 720. The switch circuit 720 comprises a switch D, a resistor R and an inductor L. The switch D is coupled between the inductive element 710 and ground element 700 for switching a connection between the inductive element 710 and the ground element 700 according to a switch signal CR_sig outputted by the RF signal processor to adjust a radiation center frequency Fc of the antenna 70. The resistor R is coupled to the switch signal CR_sig for attenuating the switch signal CR_sig to protect the switch D from damaged by an overcurrent. One end of the inductor L is coupled to the resistor R, another end is coupled to the switch D and the inductive element 710 for blocking the RF signal RF_sig on the inductive element 710 from mixing with the switch signal CR_sig, which ensures a radiation characteristic of the antenna 70. The switch D may be a Positive-Intrinsic-Negative diode or a Bipolar Junction Transistor.

Noticeably, the radiation element 702 has longest length and thus is mainly used for radiating the RF signal RF_sig within a low frequency band, the meta-material structure 706 is electrically connected to the radiation element 702, so as to change the center frequency Fc within the low frequency band.

In such a structure, the center frequency Fc of the antenna 70 may be adjusted by the switch circuit 720. In operation, when the switch D connects the inductive element 710 with the ground element 700, the center frequency Fc of the antenna 70 is a first frequency F1, while when the switch D disconnects the inductive element 710 from the ground element 700, the center frequency Fc of the antenna 70 is shifted to a second frequency F2. The second frequency F2 is greater than the first frequency F1 due to the characteristic of the meta-material structure 706.

Figure 8A:
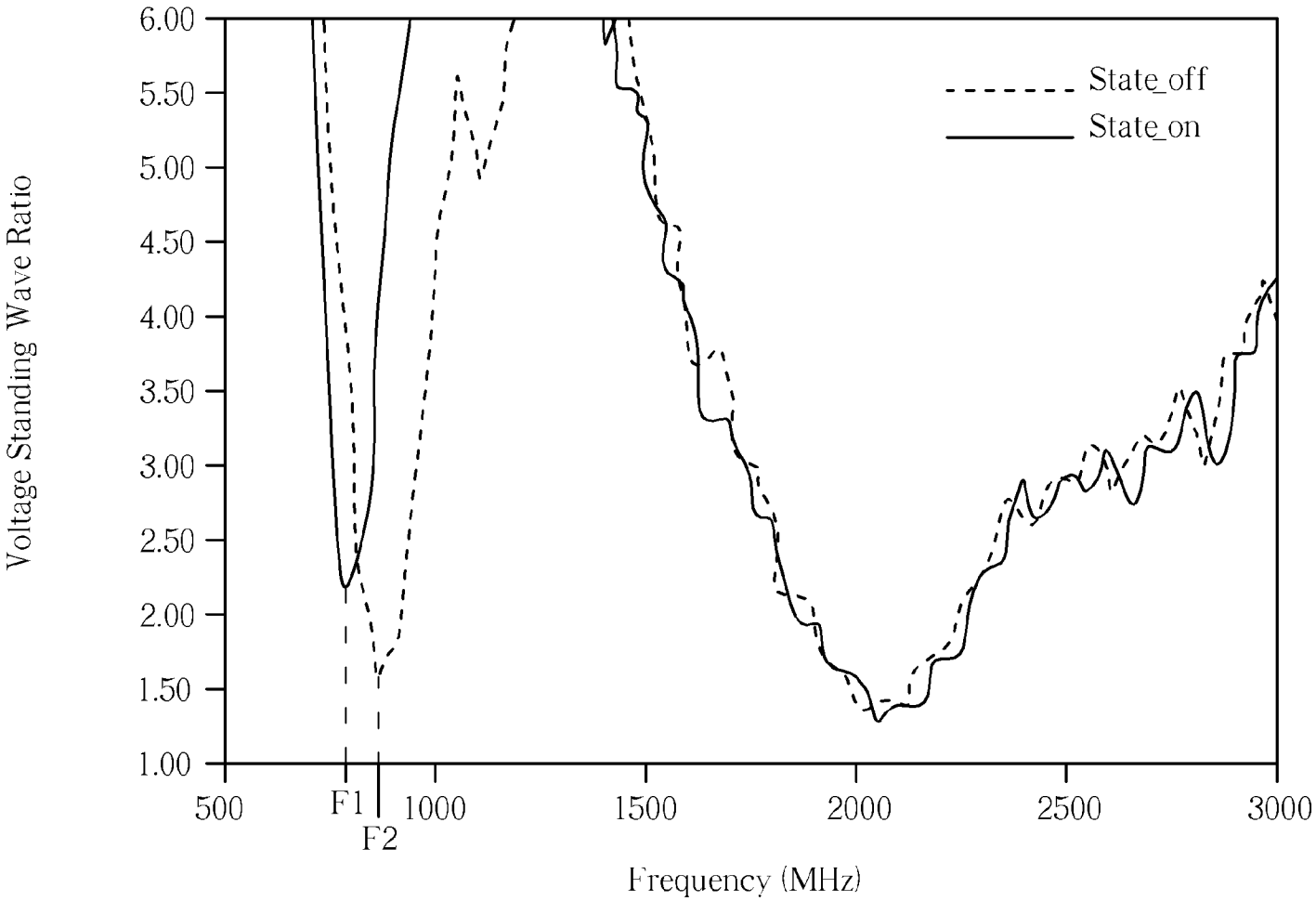
FIG. 8A and FIG. 8B are schematic diagrams of Voltage Standing Wave Ratio and efficiency of the antenna shown in FIG. 7 corresponding to different switch states.
Figure 8B:
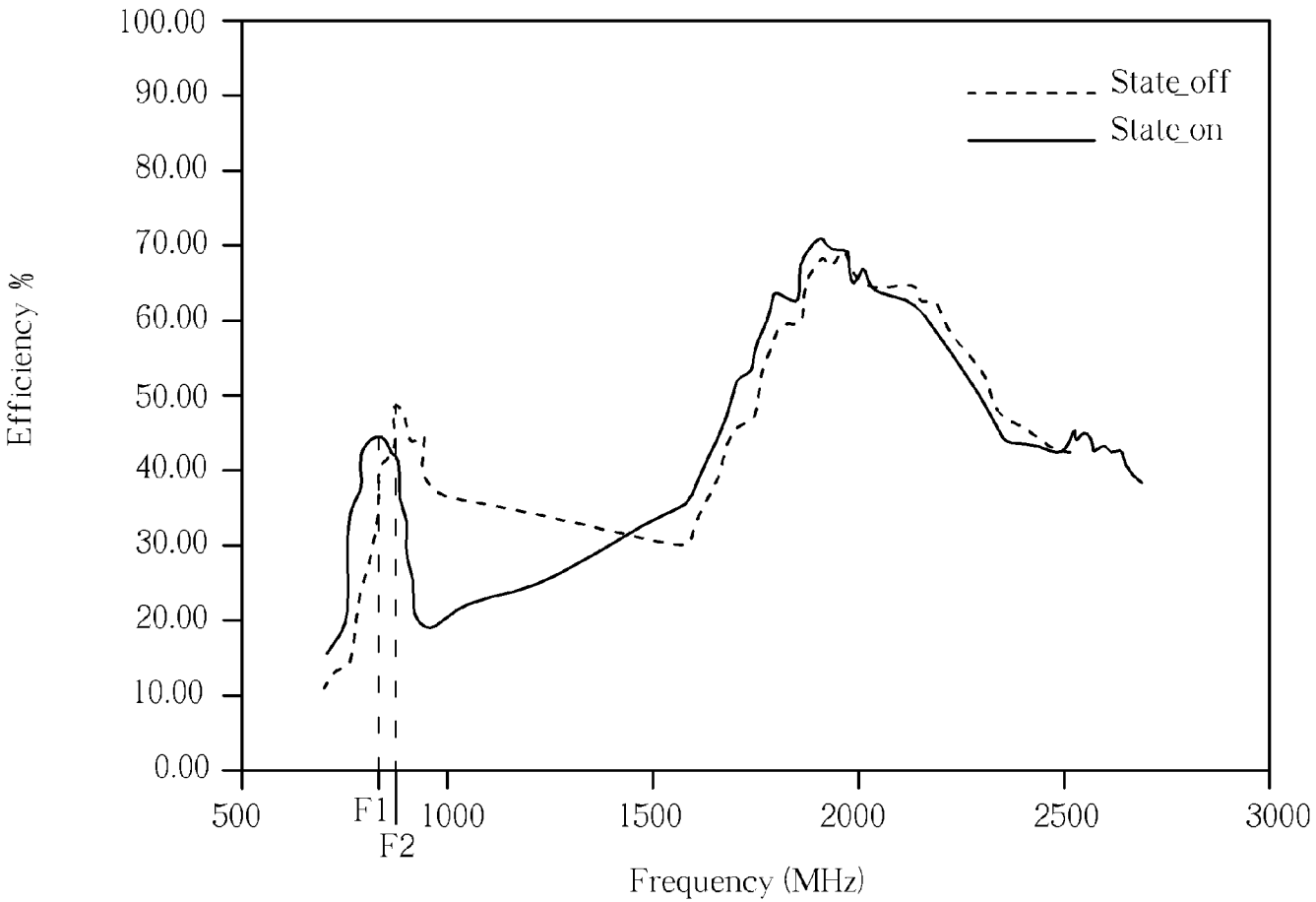

Please refer to FIG. 8A and FIG. 8B, which are schematic diagrams of VSWR and efficiency of the antenna 70 corresponding to different switch states. A switch state State_on refers to the switch D connecting the inductive element 710 with the ground element 700 and is denoted with a solid line. A switch state State_off refers to the switch D disconnecting the inductive element 710 from the ground element 700 and is denoted with a dash line. As shown in FIG. 8A, in the low frequency band that the VSWR less than 3, the center frequency Fc is the first frequency F1(≈740 MHz) at the switch state State_on, and the center frequency Fc is the second frequency F2(≈870 MHz) at the switch state State_off. In comparison, the VSWR at a high frequency band nearly remains unchanged. As shown in FIG. 8B, in the low frequency band that the radiation efficiency is greater than 40%, the center frequency Fc is the first frequency F1 at the switch state State_on, and the center frequency Fc is the second frequency F2 at the switch state State_off, while the efficiency nearly remains unchanged at the high frequency band.

Noticeably, a bandwidth (704~787 MHz) in which the first frequency F1 lies may meet a requirement of the Long Term Evolution and a bandwidth (791~960 MHz) in which the second frequency F2 lies may meet a requirement for 800 MHz and 900 MHz bands of the Global System for Mobile Communications (GSM). As a result, the center frequency Fc within the low frequency band of the antenna 70 may be adjusted by the switch circuit 720 switching the connection between the inductive element 710 and the ground element 700, which effectively reduces the antenna size within a limited space. Therefore, the antenna 70 may be able to operate in different operating frequency bands of the telecommunication systems as well.

Figure 9:
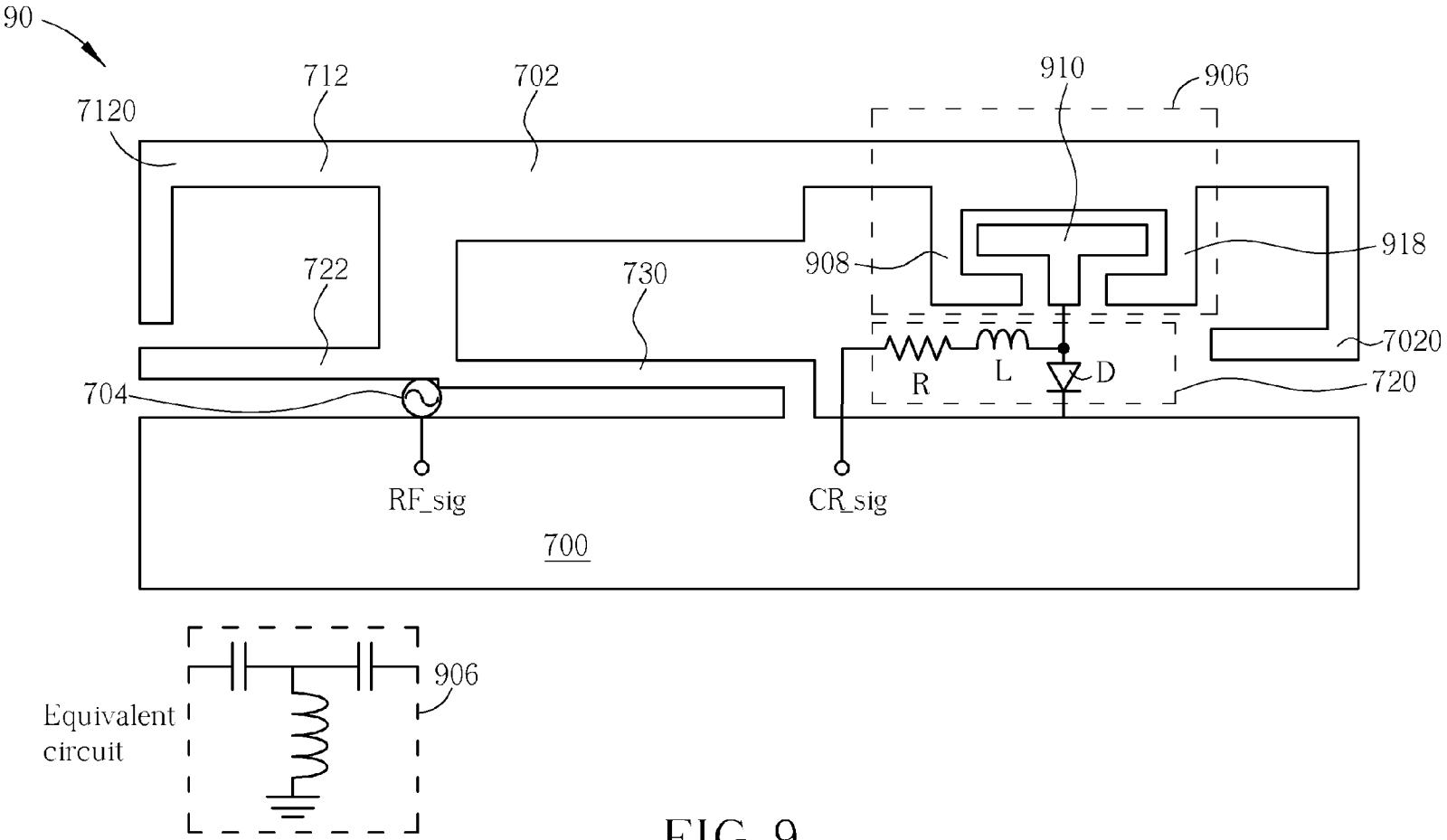
FIG. 9 is a schematic diagram of an antenna according to an embodiment of the present invention.

Please refer to FIG. 9, which is a schematic diagram of an antenna 90 according to an embodiment of the present invention. The antenna 90 is derived from the antenna 70, and same elements are denoted with the same symbols. A meta-material structure 906 of the antenna 90 is different from the meta-material structure 706 of the antenna 70. That is, the meta-material structure 906 comprises capacitive elements 908 and 918 and an inductive element 910, and the meta-material structure 906 may be equivalent to cascade two capacitors and shunt one inductor to the radiation element 702 of the antenna 90. The capacitive elements 908 and 918 and inductive element 910 may comprise at least one arm to generate different amounts of frequency shift.

Figure 10A:
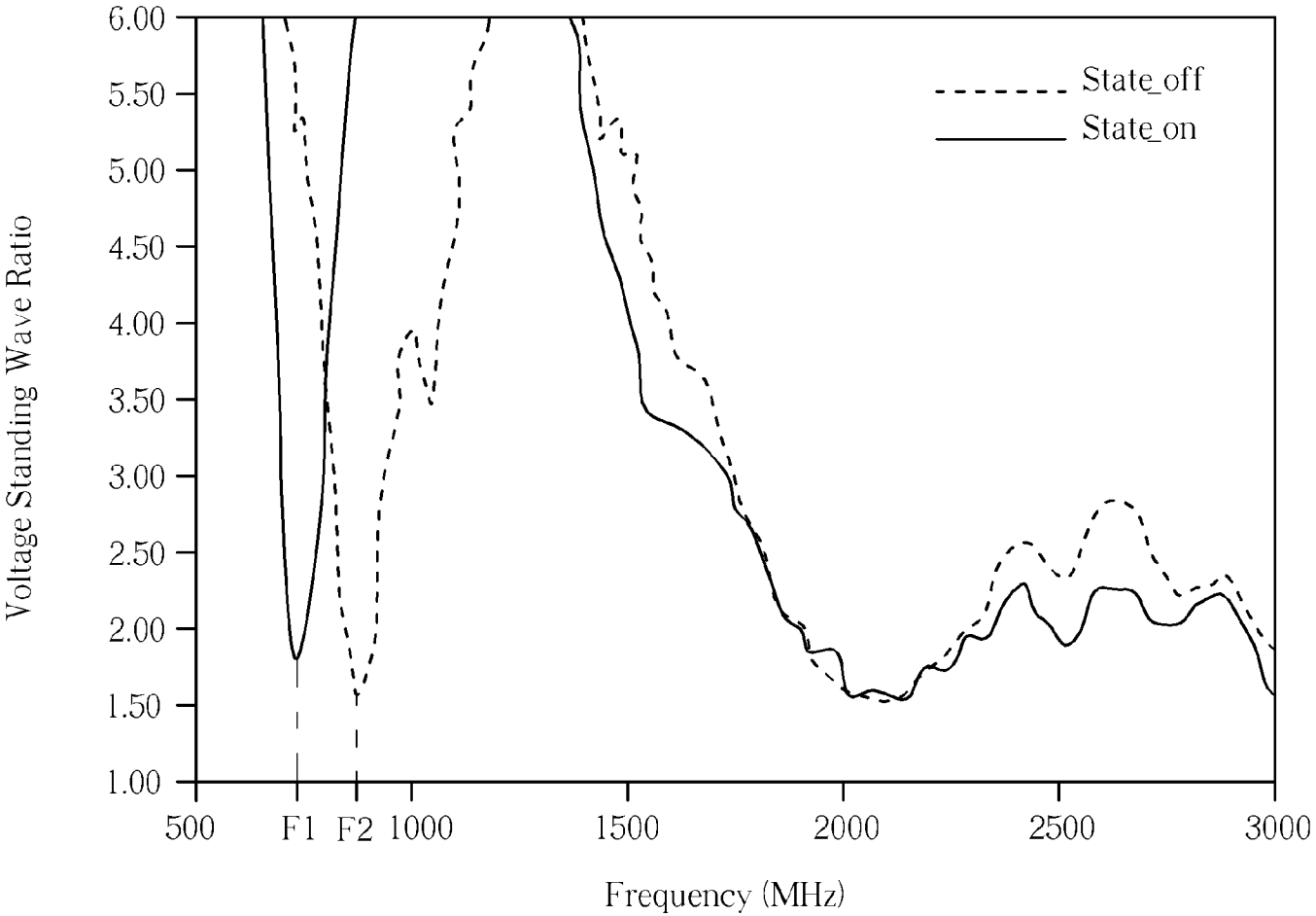
FIG. 10A and FIG. 10B are schematic diagrams of VSWR and efficiency of the antenna shown in FIG. 9 corresponding to different switch states.
Figure 10B:
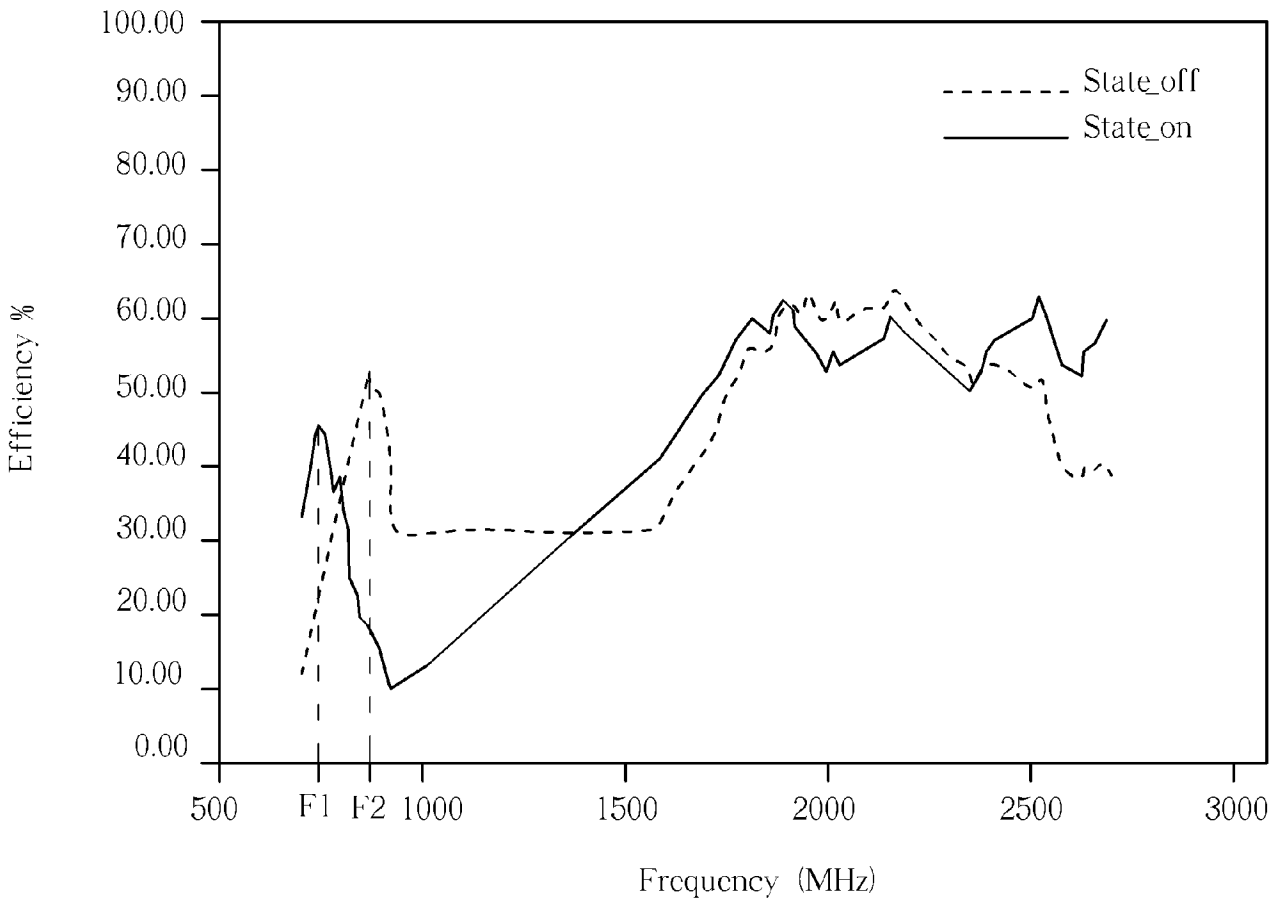

Please refer to FIG. 10A and FIG. 10B, which are schematic diagrams of VSWR and efficiency of the antenna 90 corresponding to different switch states. The switch state State_on refers to the switch D connecting the inductive element 910 with the ground element 700, and is denoted with a solid line. The switch state State_off refers to the switch D disconnecting the inductive element 910 from the ground element 700, and is denoted with a dash line. As shown in FIG. 10A, in the low frequency band that the VSWR less than 3, the center frequency Fc is the first frequency F1 (≈740 MHz, lies in 704~787 MHz) at the switch state State_on, and the center frequency Fc is the second frequency F2 (870 MHz, lies in 791~960 MHz) at the switch state State_off, while the VSWR at a high frequency band nearly remains unchanged. As shown in FIG. 10B, in the low frequency band that the radiation efficiency is greater than 35%, the center frequency Fc is the first frequency F1 at the switch state State_on, and the center frequency Fc is the second frequency F2 at the switch state State_off, while the efficiency at a high frequency band nearly remains unchanged.

To sum up, the present invention adds the meta-material structure to the radiation element of the antenna, such that the center frequency of the antenna may be shifted to a lower frequency if the length, the area and the shape of the radiation element remain unchanged, which effectively reduces the antenna size. Moreover, the present invention further combines the switch circuit with the antenna to switch the connection between the inductive element and the ground element, such that the antenna may be able to operate in different operating bands of the telecommunication system accordingly.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A wideband antenna, comprising:

a ground element electrically connected to a ground;

a feed element for feeding in a Radio-Frequency signal;

a radiation element electrically connected to the feed element for radiating the Radio-Frequency signal;

at least one meta-material structure electrically connected between the radiation element and the ground element, comprising:

a first element electrically and directly connected to the radiation element; and a second element having one end opened and another end electrically connected to the ground element; and a switch circuit comprising a switch coupled between the second element and the ground element for switching a connection between the second element and the ground element according to a switch signal, wherein when the switch connects the second element with the ground element, a center frequency of the antenna is a first frequency, and when the switch disconnects the second element from the ground element, the center frequency of the antenna is a second frequency, and the second frequency is greater than the first frequency.

2. The wideband antenna of claim 1, wherein the first element comprises at least one arm.

3. The wideband antenna of claim 1, wherein the second element comprises at least one arm.

4. The wideband antenna of claim 1, wherein the switch circuit further comprises:

a resistor coupled to the switch signal for attenuating the switch signal; and an inductor including one end coupled to the resistor, another end coupled to the switch and the second element for blocking the Radio-Frequency signal on the second element from mixing with the switch signal.

5. The wideband antenna of claim 4, wherein the switch is a Positive-Intrinsic-Negative diode or a Bipolar Junction Transistor.

6. The wideband antenna of claim 1, wherein the radiation element comprises at least one branch and at least one bend.

7. The wideband antenna of claim 6, wherein the branch of the radiation element is electrically connected to the ground element, and the wideband antenna is Planar Inverted F Antenna.

8. The wideband antenna of claim 1, which is a monopole antenna.

9. A Radio-Frequency device, comprising:

a Radio-Frequency signal processor for generating a Radio-Frequency signal; and a wideband antenna coupled to the Radio-Frequency signal processor, comprising:

a ground element electrically connected to a ground;

a feed element for feeding in the Radio-Frequency signal;

a radiation element electrically connected to the feed element for radiating the Radio-Frequency signal;

at least one meta-material structure electrically connected between the radiation element and the ground element, comprising:

a first element electrically and directly connected to the radiation element; and a second element having one end opened and another end electrically connected to the ground element; and a switch circuit comprising a switch coupled between the second element and the ground element for switching a connection between the second element and the ground element according to a switch signal, wherein when the switch connects the second element with the ground element, a center frequency of the antenna is a first frequency, and when the switch disconnects the second element from the ground element, the center frequency of the antenna is a second frequency, and the second frequency is greater than the first frequency.

10. The Radio-Frequency device of claim 9, wherein the first element comprises at least one arm.

11. The Radio-Frequency device of claim 9, wherein the second element comprises at least one arm.

12. The Radio-Frequency device of claim 9, wherein the switch circuit further comprises:

a resistor coupled to the switch signal for attenuating the switch signal; and an inductor including one end coupled to the resistor, another end coupled to the switch and the second element for blocking the Radio-Frequency signal on the second element from mixing with the switch signal.

13. The Radio-Frequency device of claim 12, wherein the switch is a Positive-Intrinsic-Negative diode or a Bipolar Junction Transistor.

14. The Radio-Frequency device of claim 9, wherein the radiation element comprises at least one branch and at least one bend.

15. The Radio-Frequency device of claim 14, wherein the branch of the radiation element is electrically connected to the ground element, and the wideband antenna is Planar Inverted F Antenna.

16. The Radio-Frequency device of claim 9, which is a monopole antenna.

* * * * *